US009127475B2

(12) United States Patent
LeAnna

(10) Patent No.: US 9,127,475 B2
(45) Date of Patent: Sep. 8, 2015

(54) ADJUSTABLE MOUNT AND UMBRELLA

(71) Applicant: David L. LeAnna, Duck River, TN (US)

(72) Inventor: David L. LeAnna, Duck River, TN (US)

( * ) Notice: Subject to any disclaimer, the term of this patent is extended or adjusted under 35 U.S.C. 154(b) by 244 days.

(21) Appl. No.: 13/842,799

(22) Filed: Mar. 15, 2013

(65) Prior Publication Data

US 2014/0263926 A1 Sep. 18, 2014

(51) Int. Cl.
*F16M 13/00* (2006.01)
*E04H 12/22* (2006.01)

(52) U.S. Cl.
CPC ..... *E04H 12/2284* (2013.01); *E04H 12/22* (2013.01); *E04H 12/2253* (2013.01); *E04H 12/2269* (2013.01)

(58) Field of Classification Search
CPC ..... E04H 12/2253; E04H 12/2269; E04H 12/2284; E04H 12/22; A45B 11/00; A45B 23/00; A45B 17/00
USPC ..... 248/518, 519, 520, 523, 534, 538, 547, 248/346.01, 188.8, 346.03; 135/16, 15
See application file for complete search history.

(56) References Cited

U.S. PATENT DOCUMENTS

| | | | | |
|---|---|---|---|---|
| 3,407,825 | A | | 10/1968 | Doyle |
| 4,154,427 | A | | 5/1979 | Hofmann |
| 4,185,360 | A | | 1/1980 | Prete, Jr. |
| 5,016,853 | A | * | 5/1991 | Cox ..... 248/523 |
| D328,840 | S | | 8/1992 | Jensen |
| 5,299,588 | A | * | 4/1994 | MacLeod ..... 135/16 |
| 5,354,031 | A | | 10/1994 | Bilotti |
| 5,394,822 | A | * | 3/1995 | Worland ..... 114/345 |
| 5,432,978 | A | * | 7/1995 | Menke et al. ..... 16/426 |
| 5,441,066 | A | | 8/1995 | Harris |
| 5,529,368 | A | | 6/1996 | Cui |
| 5,685,517 | A | | 11/1997 | Salibra |
| 5,836,327 | A | | 11/1998 | Davis |
| 5,911,399 | A | | 6/1999 | Mannion |
| 5,921,259 | A | | 7/1999 | Ehler |
| 6,089,246 | A | * | 7/2000 | Barnes ..... 135/88.06 |
| 6,113,054 | A | | 9/2000 | Ma |
| 6,397,865 | B1 | | 6/2002 | Wilson |
| 6,401,736 | B1 | | 6/2002 | Jerry |
| 6,860,280 | B2 | | 3/2005 | Wolcott |
| 6,964,277 | B2 | | 11/2005 | Naber |
| 7,040,593 | B1 | | 5/2006 | Weatherall |
| 7,264,218 | B1 | | 9/2007 | Edwards |
| 7,641,165 | B2 | | 1/2010 | Li |
| 7,740,220 | B2 | * | 6/2010 | Jeanveau ..... 248/534 |
| 7,784,761 | B2 | | 8/2010 | Ma |
| 7,819,128 | B2 | | 10/2010 | Clark |
| 8,123,190 | B2 | | 2/2012 | Kost |
| 8,291,923 | B2 | | 10/2012 | Young |
| 2002/0053631 | A1 | | 5/2002 | Li |
| 2004/0056169 | A1 | | 3/2004 | Harbaugh |
| 2010/0096876 | A1 | | 4/2010 | Fletcher |

* cited by examiner

*Primary Examiner* — Todd M Epps
(74) *Attorney, Agent, or Firm* — Miller & Martin PLLC

(57) ABSTRACT

An umbrella mount, and optional adaptor, a receiver for an umbrella pole and at least two pressure points that at least one strap and fastener can urge against a base support to securely position the mount.

20 Claims, 14 Drawing Sheets

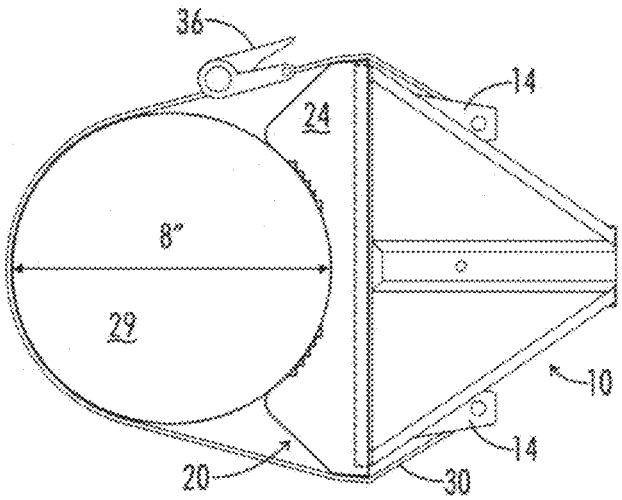
FIG. 11
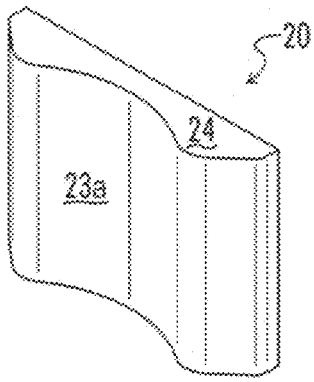
FIG. 12A
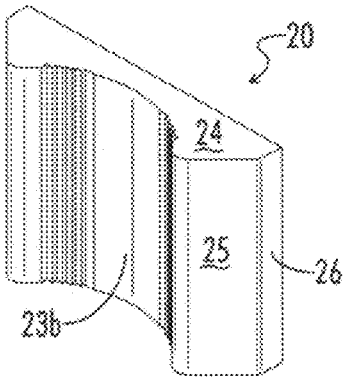
FIG. 12B
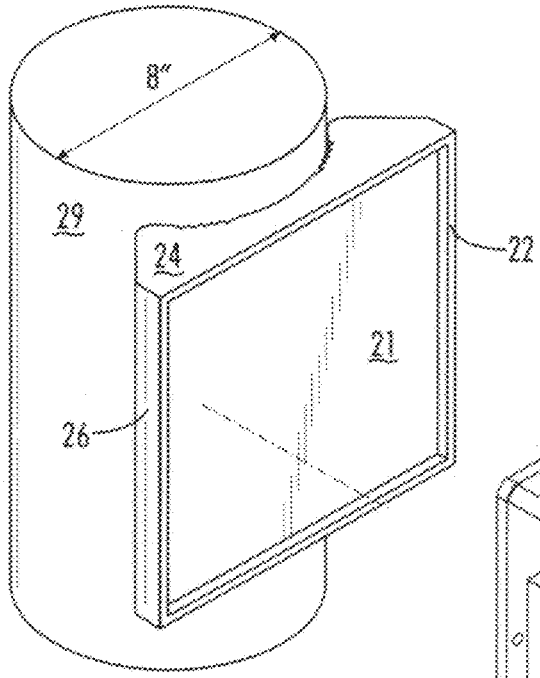
FIG. 13A
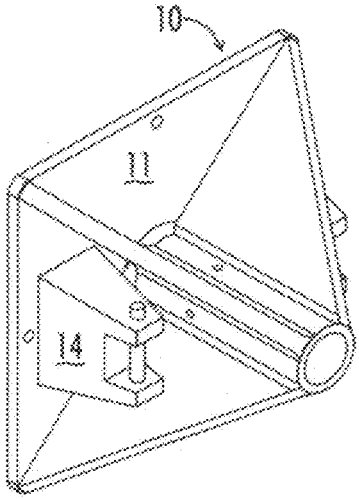

ADJUSTABLE MOUNT AND UMBRELLA

FIELD OF THE INVENTION

The present invention relates to umbrella mounts capable of stable and releasable attachment to a variety of base structures and associated umbrellas capable of varied positioning to achieve a desired orientation.

BACKGROUND OF THE INVENTION

Umbrellas are widely used to provide protection from the sun or the elements. Since umbrellas are nearly invariably used outside, it is desirable that the umbrella mounts be stable in at least light winds and breezes. Many bases have been designed to provide such stability and most commonly such bases are very heavy and the weight of the base stabilizes the umbrella mounted therein, as in U.S. Pat. No. 5,354,031. While heavy bases are useful for mounting stationery umbrellas, it is also desirable that umbrellas be movable from one location to another. One technique to provide such mobility has been to equip a heavy mounting base with wheels as in U.S. Pat. No. 7,641,175. While equipping the base with wheels provides the ability to move the base across a generally planar surface, it is still not practical to routinely lift and transport a heavy base from place to place.

Because it is often desirable to utilize an umbrella for shade in connection with a vehicle, another alternative that has been proposed is to provide a vehicle anchored mount for an umbrella as in U.S. Pat. No. 5,911,399. While such a mounting system is useful in connection with the vehicle, it does not provide a satisfactory solution in other locations. Similarly, some clamping arrangements have been devised that are suitable for mounting an umbrella to a properly positioned structure as in U.S. Pat. No. 7,040,593 or which include a clamping element as in the case of U.S. Pat. Nos. 6,401,736 and 5,836,327. Again, these clamps are only suitable for attachment to base structures of particular positions, sizes, or shapes. Two other alternatives that have been utilized are a very large base as in U.S. Pat. No. 7,264,218 or the permanent attachment of a mounting base as in U.S. Pat. No. 5,680,517 and U.S. Published Patent Application No. 2002/0053631. Permanent mounting of the umbrella base can provide excellent stability but is not suitable for mobility.

Several alternative techniques for utilizing umbrellas in connection with vehicles have been proposed, including trailer hitch attachments such as are disclosed in U.S. Pat. Nos. 7,818,128 and 8,123,190 or particularly designed mounting structures that are fixed to the vehicle as in U.S. Published Patent Application No. 2010/0096876 and U.S. Pat. No. 5,529,368. These attachments are only suitable for use on a particular vehicle and do not provide the ability to releasably attach the umbrella to a variety of different base structures. An improved umbrella mount is still needed can be mounted to a wide variety of base structures, while providing variable umbrella positioning and being simple and inexpensive to make and use.

BRIEF SUMMARY OF THE INVENTION

A novel umbrella mount and adapter is provided for fixed or releasable attachment to a base structure. The base structure may commonly be a table or a truck tailgate. In addition, a pole and beam adapter is provided to allow the mount to be releasably attached to poles, trees, beams, rectangular truck bumpers, and similar base structures, most typically, but not necessarily, in vertical or horizontal orientations. The mount and adapter are releasably secured in place through the use of a strap or straps that encircle the base structure and can be tightened with a fastener, such as a ratchet to hold the mount securely in place. The mount can be designed to permit the umbrella post to be fixed in a variety of orientations when utilized with a either a straight or angled base pole and a tilting head umbrella. If the angled base pole can be rotated through a variety of orientations with respect to the base, the umbrella canopy can be positioned in almost any desired position to provide desired shelter from sun or the elements.

These and other aspects of the novel umbrella mount will become apparent in review of the drawings and detailed description of the invention.

BRIEF DESCRIPTION OF THE DRAWINGS

FIG. 11 is a top plan view of a mount on an adapter and secured about a pole with a strap and fastener.

FIG. 12A is a perspective view of an adapter with a smooth mounting surface.

FIG. 12B is a perspective view of an adapter with a notched mounting surface.

FIG. 13A is an exploded perspective view of the mount of FIG. 1 and adapter of FIG. 12B positioned to attach to a vertical pole.

DETAILED DESCRIPTION OF THE DRAWINGS

Figure 1:
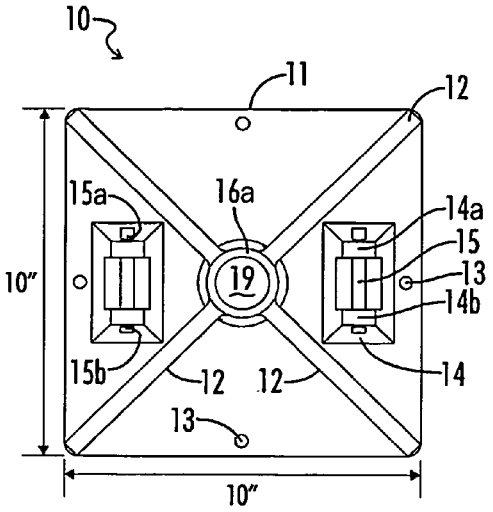
FIG. 1 is a top plan view of an umbrella mount according to the invention.
Figure 2:
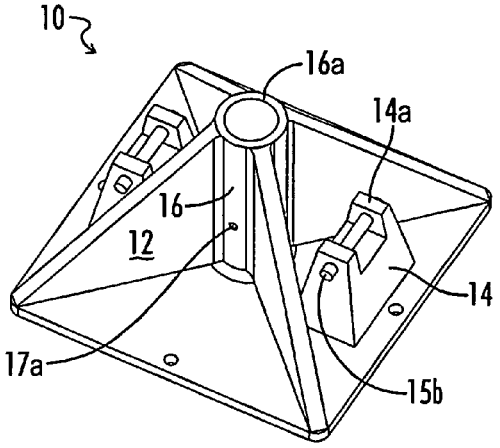
FIG. 2 is a perspective view of the mount of FIG. 1.
Figure 3:
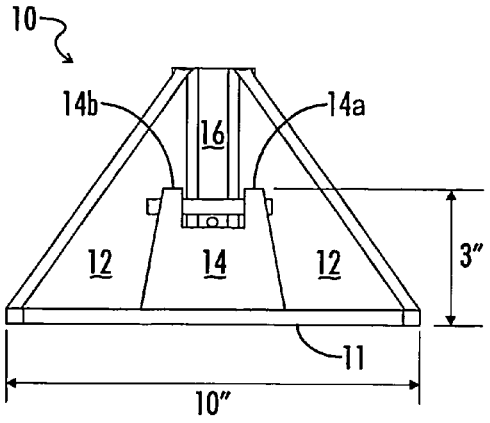
FIG. 3 is a left plan view of the umbrella mount of FIG. 1, the right plan view being substantially identical.
Figure 4:
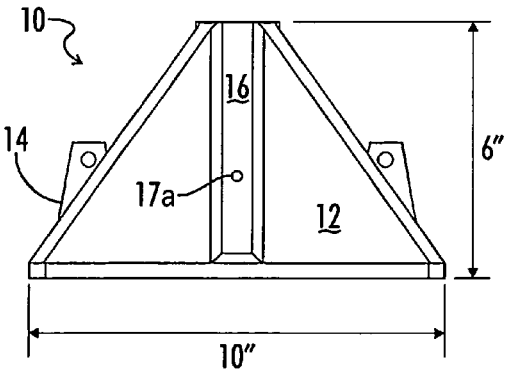
FIG. 4 is a front plan view of the mount of FIG. 1, the back view being substantially identical.
Figure 5:
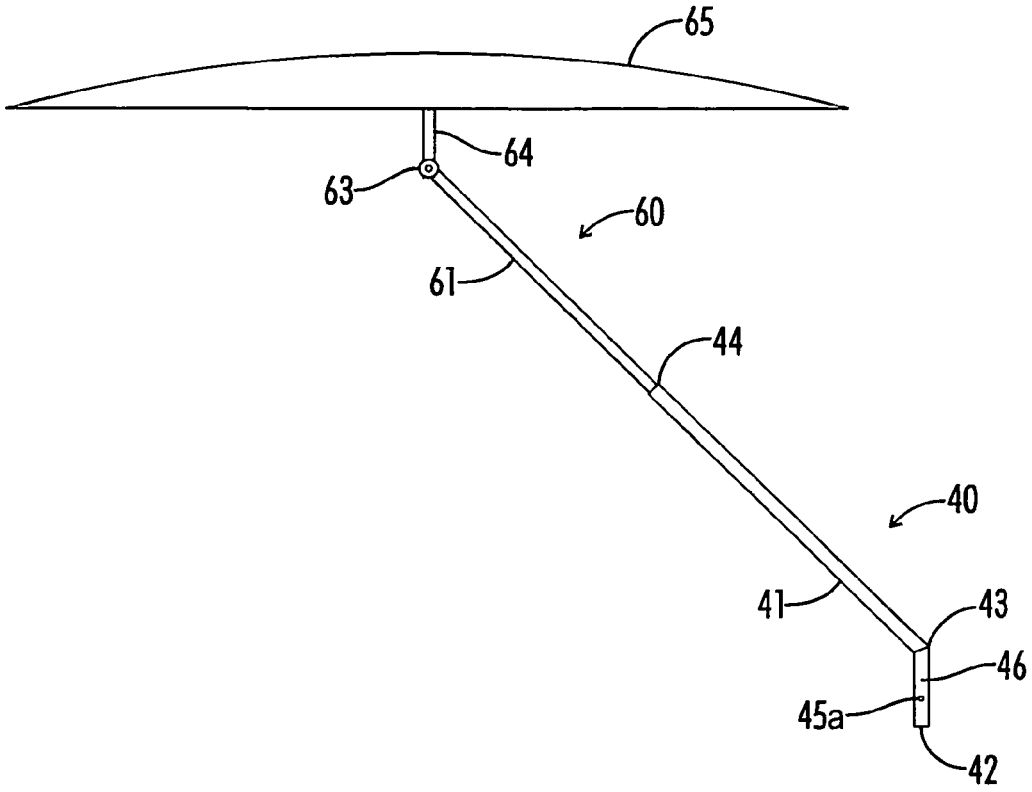
FIG. 5 is a side plan view of a tilt head umbrella positioned on a 45° angle base pole.
Figure 6:
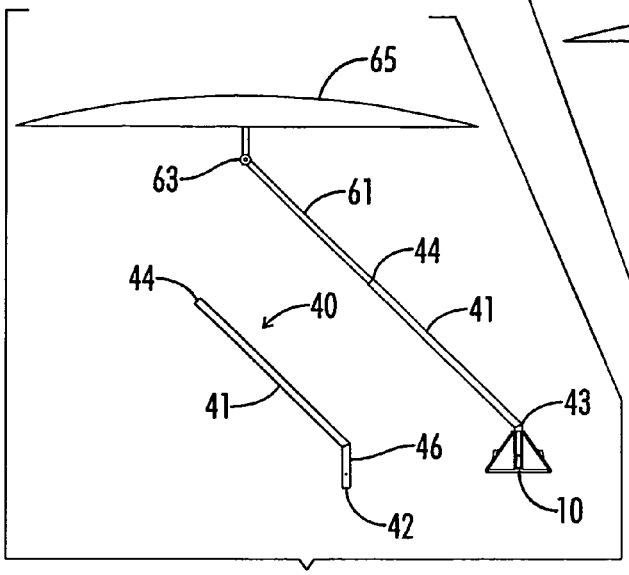
FIG. 6 is a side plan view of the umbrella of FIG. 5 in a mount, with the 45° angle base pole also shown in isolation.

Turning first to FIGS. 1 through 4, an exemplary umbrella mount 10 useful in practicing the invention is illustrated. The mount 10 consists of a generally planar base 11, corner supports 12 that support generally upright pole receiver such as cylindrical tube 16, normal to the base. Tube 16 has an opening 19 sized to receive the external diameter of an umbrella base pole and preferably has a height from base 11 to upper edge 16*a* of about 6 inches. The pole receiver, and its interior opening, can have a variety of sectional shapes so long as the interior opening will accommodate the associated base poles. While a circular sectional opening 19 is illustrated, the use of polygons, and particularly triangles and pentagons, are also suitable so long as the associated base poles have similar shapes.

The planar base 11 also has a plurality of apertures 13 that may be utilized with threaded fasteners, such as screws or bolts, to more permanently position the base in a selected location. The cylindrical tube 16 also has intermediate openings 17*a* in lateral alignment on opposed sides so that a pin can be passed through openings 17*a* across a diameter of the tube 16. The openings 17*a* may appear on each quadrant of the tube 16 or only on two opposed quadrants. As reflected in FIG. 18, additional openings 17*b* may be positioned at a different vertical distance from the base 11 along the cylindrical tube 16.

Figure 19:
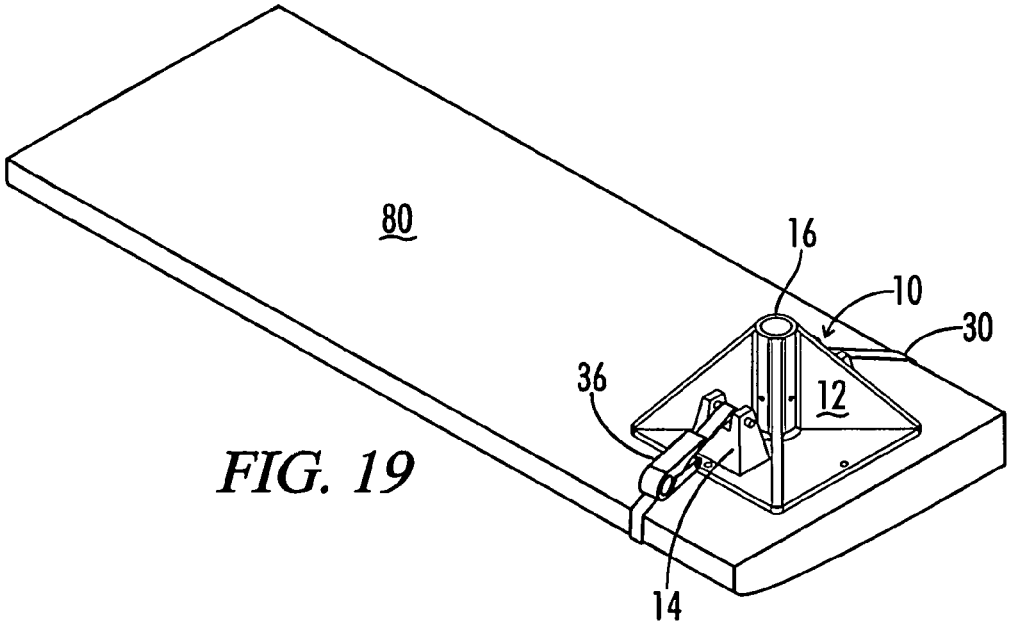
FIG. 19 is a perspective view of a mount secured by strap to a truck tailgate shaped base structure.
Figure 20:
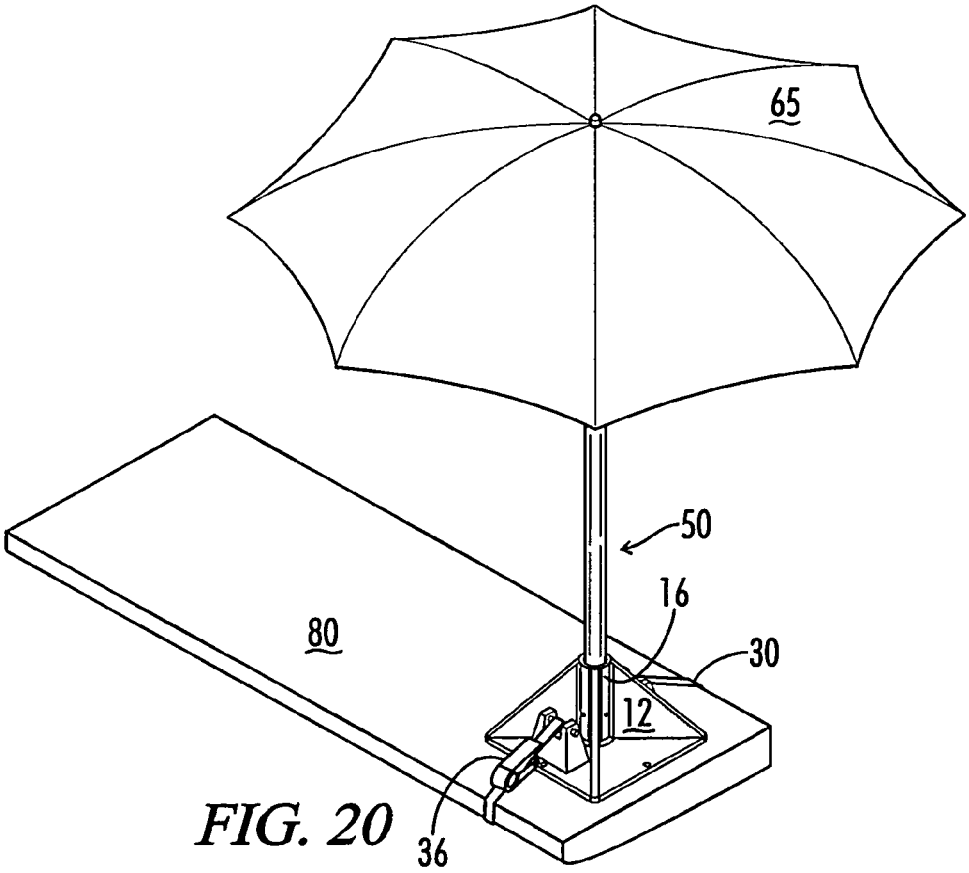
FIG. 20 is a perspective illustration of the secured mount of FIG. 19 with an umbrella having a straight base pole received in the mount.
Figure 21:
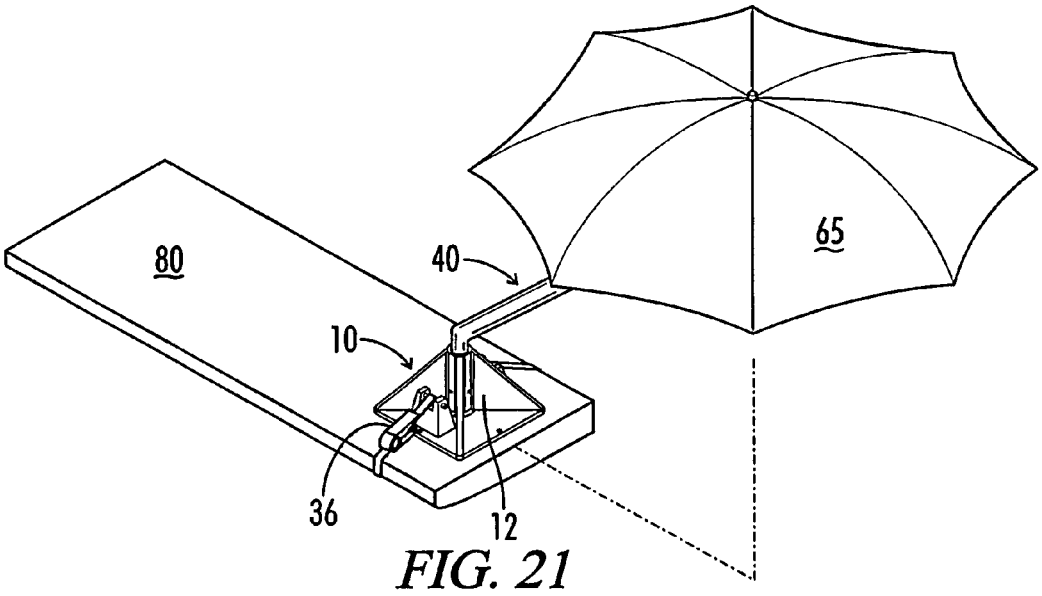
FIG. 21 is a perspective illustration of the base of FIG. 19 with an umbrella having an angled base pole received in the mount.

Central to the operation of the mount 10, are the presence of at least two strap pressure points where a strap cooperating with base 10 can exert downward pressure on the base 10 against a fixed base structure such as a table or tailgate, or horizontal pressure against a vertical base structure. In the illustrated embodiment, the strap pressure structures are formed of risers 14 with right castellation 14*a* and left castellation 14*b* in the shape of a clevis and creating a channel. A pin 15 is journaled across openings in castellations 14*a* and 14*b* so that right pin end 15*a* and left pin end 15*b* are visible on the exterior of the riser 14 while the central portion of pin 15 may hold a strap in position. The strap may have a fixed loop end that the pin 15 is positioned through into place on the riser 14, or the strap may be passed under and around the pin 15 already mounted in the riser 14 and then to a buckle or fastener. FIGS. 19 through 21 illustrate a strap 30 in position on riser-type pressure points.

Figure 7:
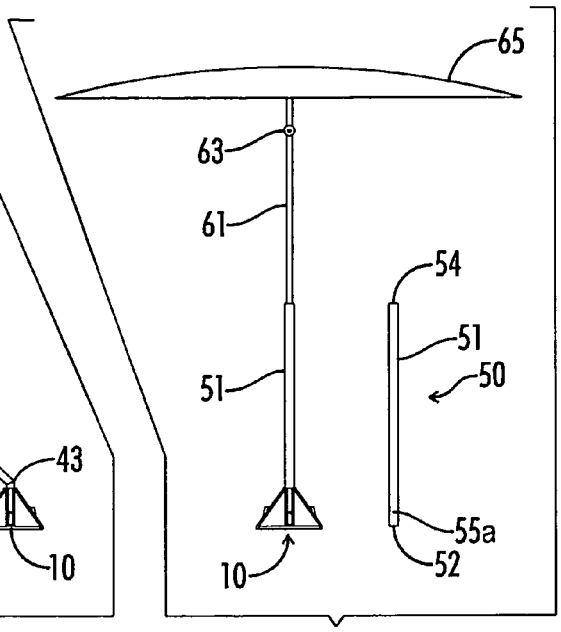
FIG. 7 is a side plan view of an umbrella with a straight base pole in a mount.

Turning then to FIGS. 5 through 8, the constituent components of the umbrella utilized with mount 10 are illustrated. These components consist of the umbrella assembly 60, and angled base pole 40 shown in FIG. 5. A straight base pole 50 shown in FIG. 7 is also provided. The umbrella assembly 60 consists of the actual canopy or awning 65, canopy connector 64, swivel joint 63, and pole 61 with end 62 (shown in FIG. 8). The end 62 is received within top end 44 of angled base pole 40 in FIG. 5. The angled base pole 40 has a main shaft 41, a 45-degree angle 43 and a base 46 extending to end 42. The base 46 has openings 45*a* that allow a pin to be passed through a diameter of base 46. It can be seen in FIG. 6 that the base end 46 of angled base pole 40 is received within the opening 19 (shown in FIG. 1) of mount 10. This causes the canopy 65 to be offset from the base. In order for the canopy 65 to be parallel to the ground, the swivel joint 63 is adjusted at a 45-degree angle opposite to the 45-degree angle 43 of pole 40. The extension distance provided by poles 61 and 41 can be adjusted in any of several well-known fashions by controlling the length of pole 61 that is received within the end 44 of angled base pole 40. Often, a series of apertures is provided on the larger pole 41 and a spring-loaded button mechanism is provided near the end 62 of the umbrella pole 61. The buttons can be depressed and released to interfit in apertures at an appropriate point along pole 41 to obtain a desired length.

FIG. 7 illustrates the alternative straight base pole 50 comprised of main shaft 51, base end 52 that is received within the opening 19 of the mount 10 with aligned openings 55*a* on opposed sides to permit a pin to pass through the diameter of the shaft 51. Pole 50 also has an opposite upper end 54 that will receive base 62 of main umbrella pole 61. When utilizing the straight base pole 50, the canopy 65 is located directly above the mount 10 and there is no need to utilize the tilt mechanism 63 to keep the canopy parallel to the surface below.

The base 46 of base pole 40 and base 52 of straight base pole 50 are illustrated with circular sectional profiles for use with tubular pole receiver 16. When using a circular sectional profile, it may be necessary to use locking pins to fix an angled base pole in the desired orientation. An alternative is to use a pole receiver and base with a polygon shaped sectional profile, and preferably an equilateral triangle or pentagon. When a triangular profile is used with a symmetrical mount, a total of six different orientations for an angled base pole are possible, providing a possible fixed location at every 60° of rotation. This is accomplished with the mount in a first position and the triangular profile permitting the angled base pole to extend at three locations that can be represented as 0°, 120°, and 240°. To obtain the other three possible positions, the mount is rotated through 180° so that the triangular profile of the pole receiver faces in the opposite direction and now the angled base pole can extend at 60°, 180°, and 300°. When a pentagon shaped profile is used, the angled base pole can be positioned at every 36° around the circle.

Figure 8:
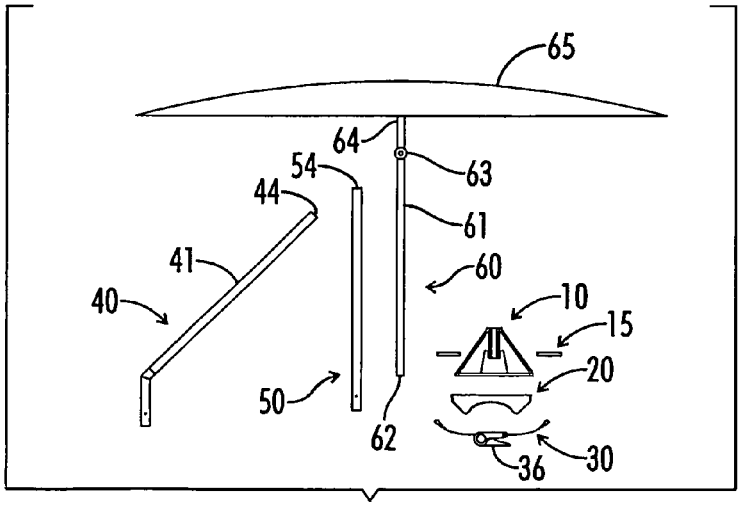
FIG. 8 is an elevation view of the components of an exemplary umbrella and mount system including tilt head umbrella, a 45° angle base pole, straight base pole, mount with pins, adapter, and strap with fastener.

FIG. 8 shows a complete set of components that can be provided in kit form or a carrying bag to allow this adjustable mount and umbrella to be carried and used in many various locations. The elements include the umbrella assembly 60, straight base pole 50, angled base pole 30, mount 10, pins 15, adaptor 20, and strap 30 with fastener 36.

Figure 9:
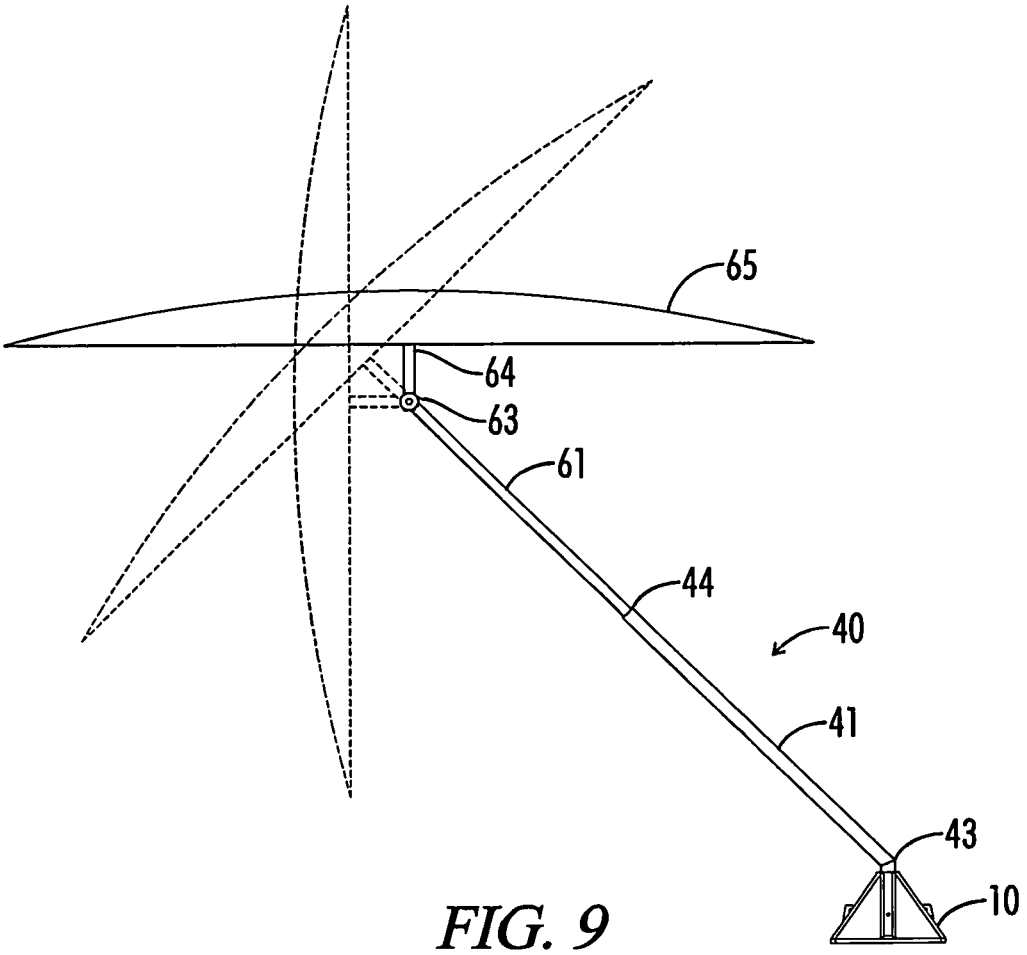
FIG. 9 is a side plan view of the umbrella of FIG. 6 utilizing the tilt head feature to position the umbrella canopy horizontally, vertically, and at an intermediate angle.
Figure 10:
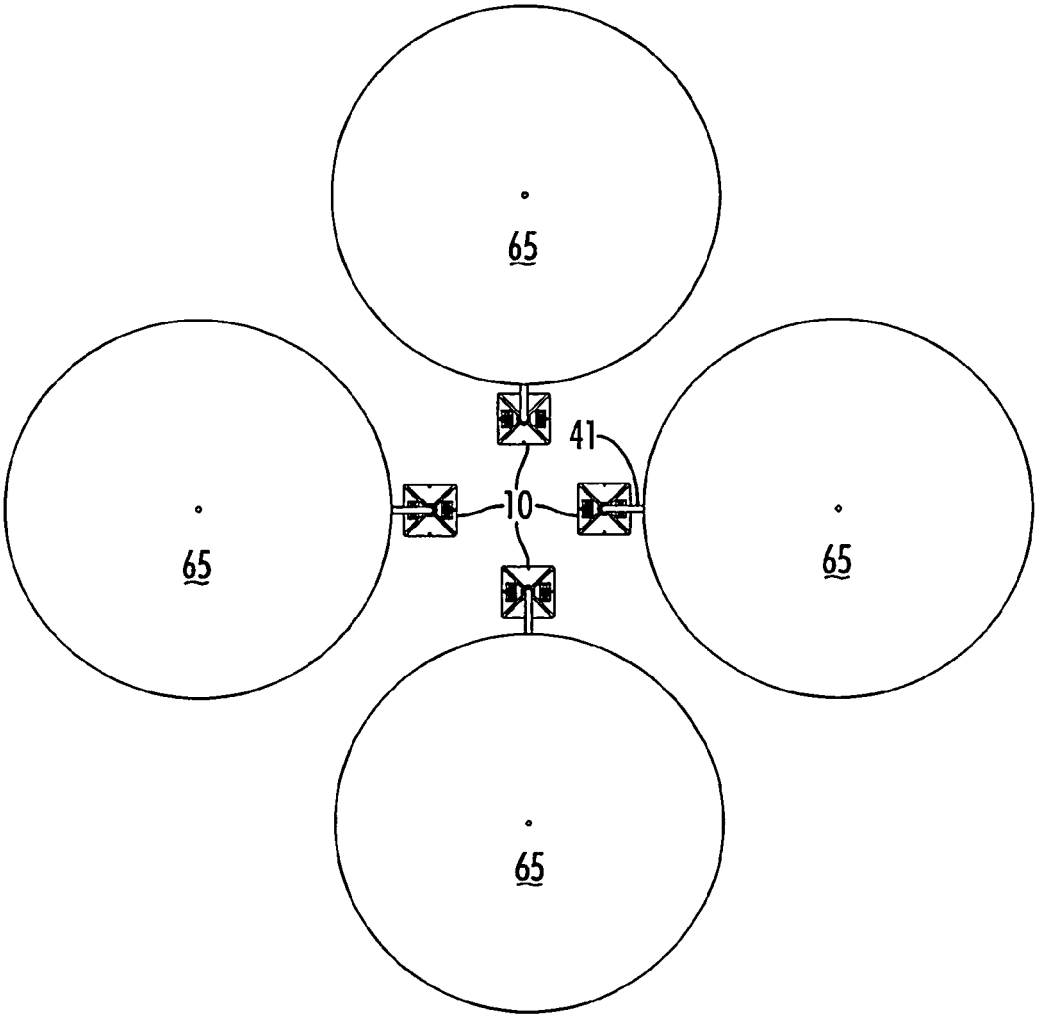
FIG. 10 is a top plan view of four umbrellas, each utilizing an angled base pole but positioned at different orientations relative to their mounts.

Turning next to FIGS. 9 and 10, exemplary configurations of the umbrella, and mount utilizing angled base pole 40 are shown. In FIG. 9 the mount 10 is in a horizontal position, the base end 46 of angle base pole 40 is received in the opening 19 of the cylindrical tube 16 of the mount 10, the bottom end 62 of umbrella pole 61 is received within the top end 44 of the angled base pole 40, and the tilt mechanism 63 is shown in solid holding canopy 65 in horizontal position and in phantom at 45° and 90° angles from the horizontal. FIG. 10 is a representation of four horizontally positioned mounts 10 with angled base poles 41 extending canopies 65 outward from a central position. Canopies 65 are typically about 6 to 10 feet in diameter, and preferably about 7 to 9 feet.

Figure 13B:
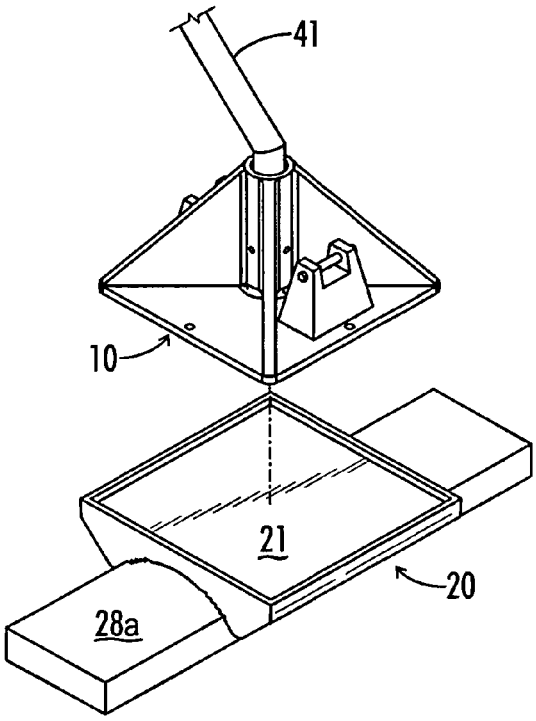
FIG. 13B is an exploded perspective view of the mount with 45° angle base pole and adapter for attachment to a 2×6 inch beam.
Figure 13C:
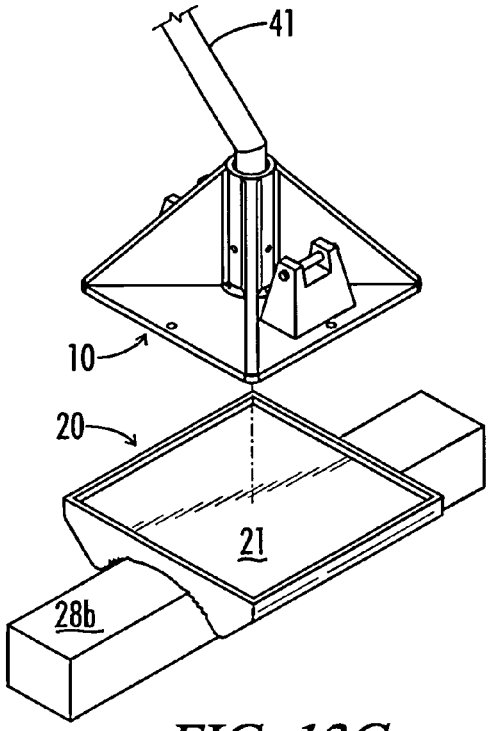
FIG. 13C is an exploded perspective view of the mount with 45° angle base pole and adapter for attachment to a 4×4 inch mounting beam.
Figure 13D:
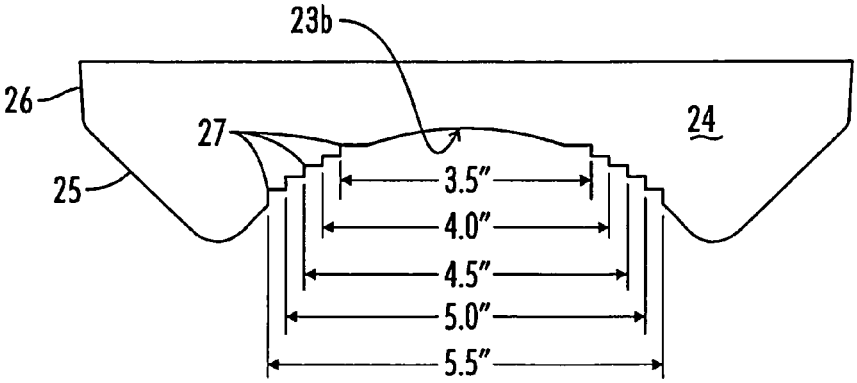
FIG. 13D is an end plan illustration showing exemplary dimensions for the notched mounting surface of the adapter of FIG. 12B.

An additional feature of the umbrella mount is an adaptor component that is particularly useful in allowing the mount 10 to be secured to a pole or rectangular member. Such an adaptor 20 for use in mounting on rounded members such as poles or trees up to about eight inches in diameter is shown in FIGS. 12A, 12B and 13D in isolation and in FIGS. 11 and 13A-13C in place on pole 29 or rectangular member 28*a*, 28*b*. The adaptor has a planar top 21 surround by flange 22 sized to receive the base 11 of mount 10 as shown in FIG. 13A. Opposite the planar top 21 is a generally arcuate surface 23*a*. In a particularly preferred embodiment, this arcuate surface is not smooth but notched. Arcuate surface 23*b* is notched with spaced notches 27 to particularly match common widths of rectangular members such as 2×4 and 2×6 lumber, or rectangular metal bumper attachments for vehicles.

In FIG. 11, the mount 10 is shown with strap 30 attached to risers 14 and extending around adaptor 20 and generally round pole 29 and tightened in place by fastener 36 which may be a buckle or cinch, but preferably is a ratchet type mechanism. The strap is typically made from a durable fabric such as nylon, polypropylene or polyester, but other materials are possible. FIGS. 13B and 13C show the adaptor 20 positioned on rectangular support base members 28*a*, 28*b*. FIG. 13B illustrates the notching of the interior generally curved surface 23*b*. It can also be seen that the profile of adaptor 20 on the curved side extends back from the edges of a generally curved surface 23*b* at an angle 25 and then nearly normal to the planar top along section 26.

Figure 14:
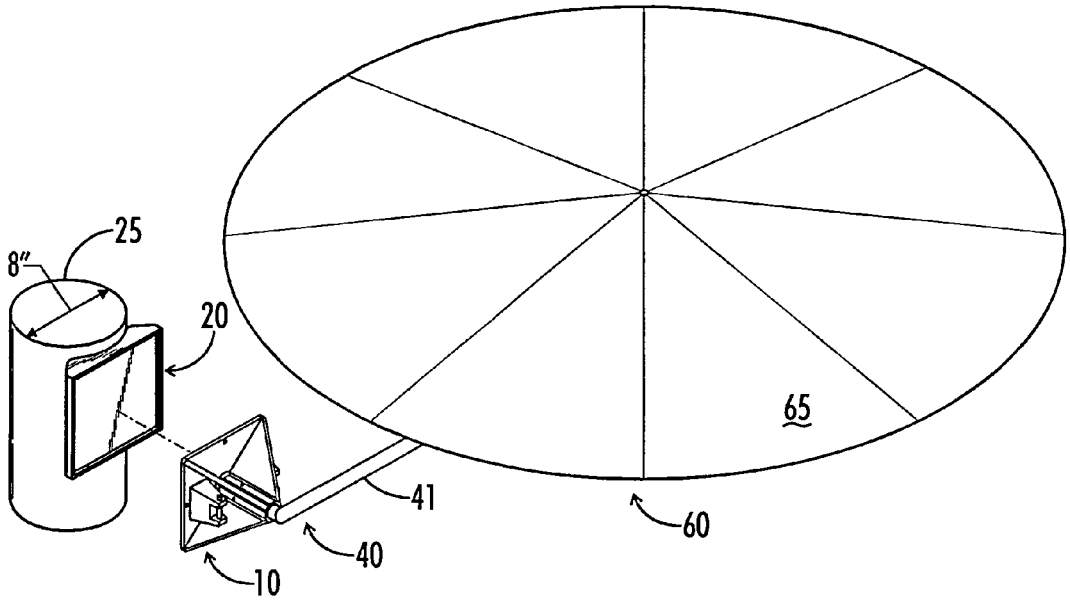
FIG. 14 is a perspective view of the mount and adapter of FIG. 13A with an umbrella and 45° angle base pole.
Figure 15:
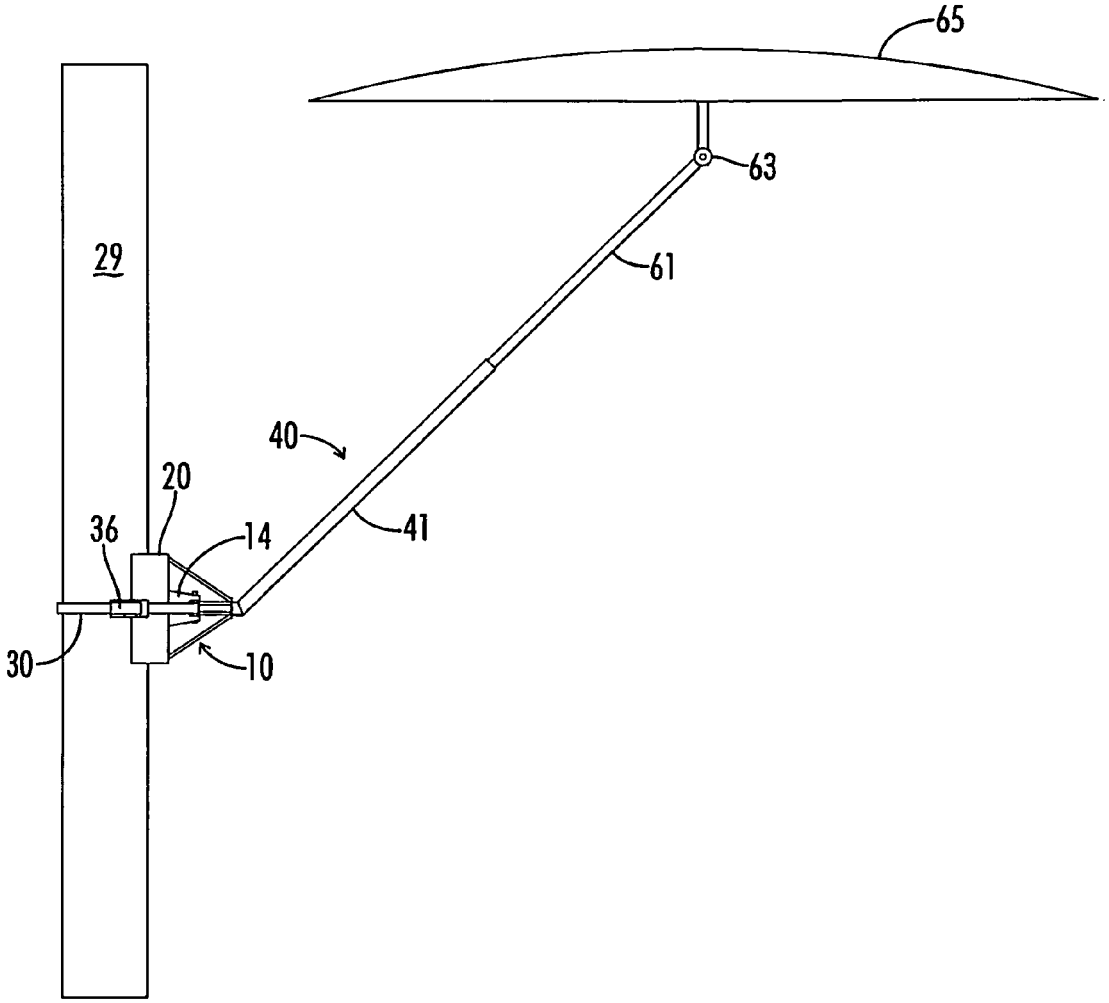
FIG. 15 is a side plan illustration of the umbrella mount and adapter of FIG. 14 secured about the vertical pole with strap and fastener.

FIG. 14 shows an exploded view of the attachment of mount 10 to adaptor 20 in position on a vertical pole 29 with an angled base pole 40 received in the mount 10 and connected to the umbrella portion 60 with canopy 65. A side plan view of that assembly with strap 30 secured around pole 29 in connection with risers 14 on mount 10 is shown in FIG. 15. The end points of the strap 30 are looped over pins 15 held by risers 14, thus each pin 15 applies pressure through riser 14 to press the mount 10 against the adapter 20 and in turn against the pole 29. It can be seen that a strap or straps must pull at least two pressure points on the mount 10 against the base structure. The pressure points should be disposed on opposite sides of the pole receiver. FIG. 15 also illustrates angle base pole 40 orienting the shaft of the umbrella upwards at a 45° angle and the swivel mechanism 63 reversing the 45° angle to hold the canopy 65 in a horizontal position.

Figure 16:
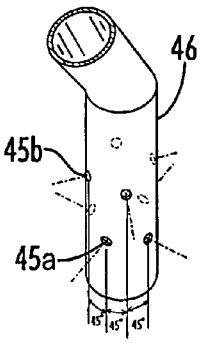
FIG. 16 is a perspective view of a portion of a 45° angle base pole that is received in the mount.
Figure 17:
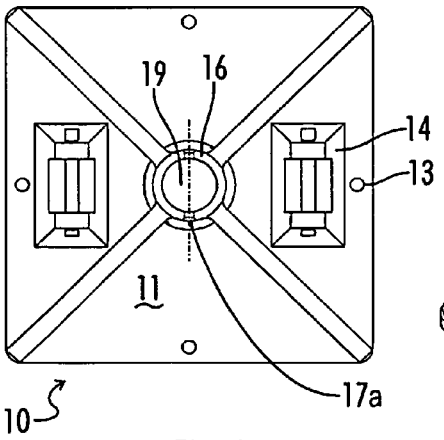
FIG. 17 is a top plan view of a mount illustrating the laterally aligned apertures for rotational alignment with base pole apertures.
Figure 18:
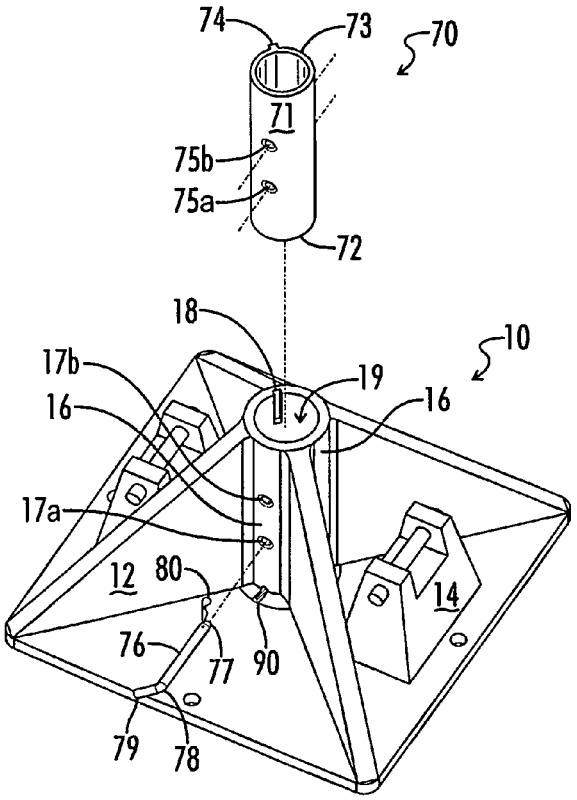
FIG. 18 is a perspective view of a mount with an insert to accommodate smaller diameter base poles.

FIGS. 16 through 18 illustrate particularly preferred embodiment of the mounting section 46 of base pole 40, and a cylindrical tube 16 is used on mount 10 receiving the base pole section. Specifically, the base section 46 of angled base pole 40 is shown in isolation in FIG. 16 with both lower apertures 45*a* and upper apertures 45*b*. There are four apertures 45*a*, each offset 90° from one another so that a pin can pass through opposed apertures across the diameter of section 46. The upper apertures 45*b* are similarly offset from one another by 90° and are also offset from the apertures 45*a* by 45°. Thus, when the base section 46 is placed in the opening 19 of tube 16 of mount 10, as shown in FIG. 18, locking pin 76 can be passed through lower opening 17*a* or upper opening 17*b* to correspond with openings 45*a* or 45*b* in the bottom section of 46 thereby permitting the angled base pole 45 to be rotated to any 45° angle and locked in place by passing pin shaft 76 through the apertures and attaching a fastener 80 to end 77, while angle 78 keeps the gripping end 79 of the pin 76 on the opposite outer side of tube 16. The openings 17*a*,17*b* in tube 16 are preferably offset from risers 14 so that there is ample space to easily insert and lock pin 76.

Because the straight base pole 50 does not need to be rotated, it is not necessary that it be provided with apertures like the bottom section 46 of angled base pole 40. Similarly, if the profile of the receiver and pole base are a matching polygonal shape, such as a triangular section or a pentagon, there is no necessity for apertures and a locking pin since the interfitting profiles will not rotate with respect to one another. In addition, the mount 10 can be configured to accept smaller diameter base poles by the addition of a keyed insert 70. In this case the top edge 16*a* of tube 16 of mount 10 has a keyway 18 to mate with a key 74 on the insert 70. The tubular portion 71 of insert 70 is sized to fit the opening 19 in tube 16 and the keyway 18 ensures that apertures 75*a* and 75*b* of the insert 70 will align with apertures 17*a* and 17*b* on tube 16. The upper end 73 of insert 70 will be nearly flush with the upper end 16*a* of tube 16 and lower end 72 will extend to the base 11 of mount 10. The use of insert 70 facilitates the situation where the mount is used on a table and the additional height or offset of a base pole 40, 50 is not needed. In that case, the end 62 of umbrella pole 61 may be fitted directly into the insert 70 within the pole receiver. The tube 16 can also be provided with a small drain hole 90 at its lower end where it joins the base to prevent the accumulation of any moisture.

Figure 22:
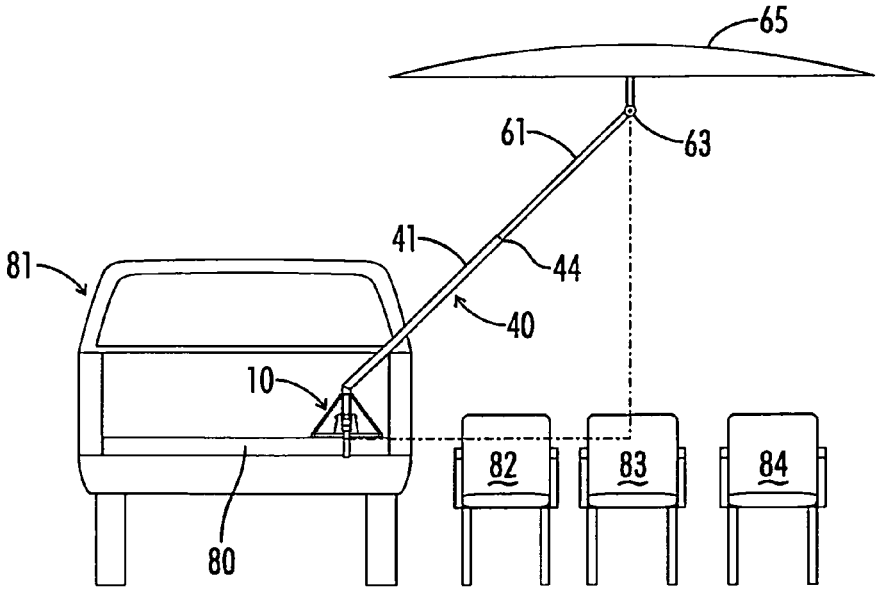
FIG. 22 is an end view of a mount attached with a strap to a pickup truck tailgate utilizing a 45° angle base pole at full extension over three chairs.
Figure 23:
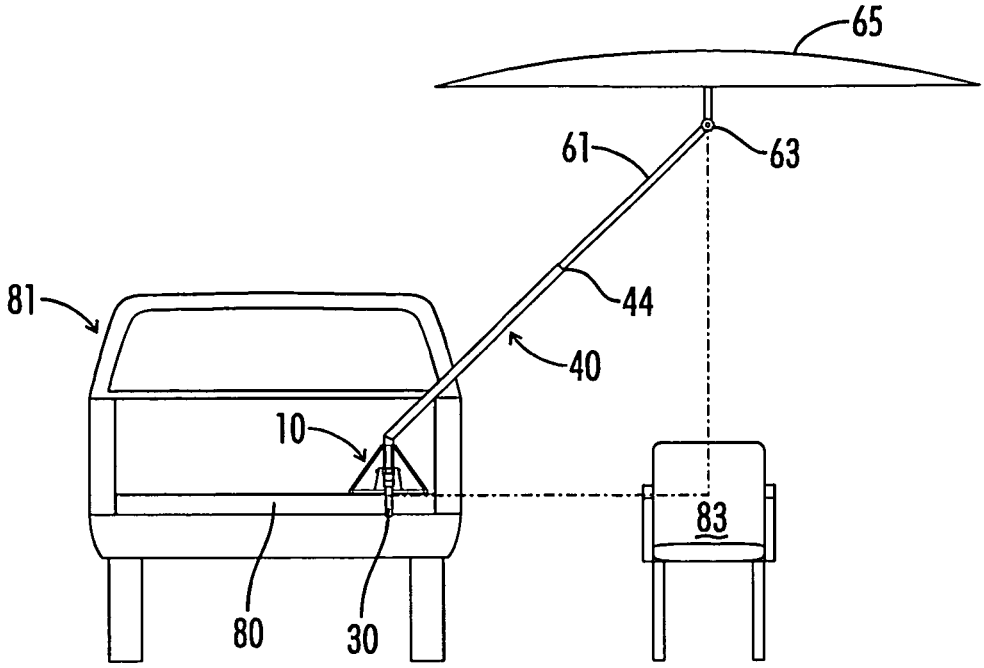
FIG. 23 is an end view of a mount attached with a strap to a pickup truck tailgate utilizing a 45° angle base pole at full extension over a single chair.
Figure 24:
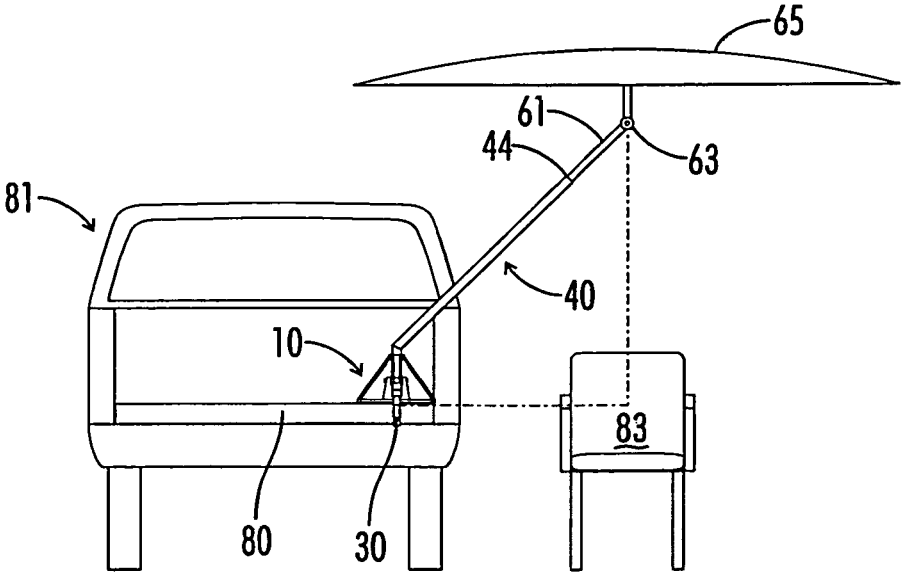
FIG. 24 is an end view of a mount attached with a strap to a pickup truck tailgate utilizing a 45° angle base pole at reduced extension over a single chair.

FIGS. 19 and 20 illustrated the attachment of the mount to a base structure in the shape of a pickup truck tailgate 80. The mount 10 is secured in place by strap 30 connected to downward pressure positions on opposite sides of the umbrella pole mounting receiver 16, and held tightly in place by fastener 36. In FIG. 20, a straight base pole 50 is inserted in the cylindrical tube portion 16 of base 10 holding the canopy 65 of the umbrella directly above the mount 10. In FIG. 21, the straight base pole 50 has been replaced by the angled base pole 40 which results in the canopy 65 being offset from the mount 10 that is located on the tailgate 80. As best illustrated in the wide field of view illustration of FIG. 22, the base support is tailgate 80 on pickup truck 81 and the canopy 65 of the umbrella is at horizontal by virtue of operation of swivel joint 63 to counter the 45 degree angle imparted by angle base pole 40. It can be seen that the canopy 65 substantially covers three chairs 82,83,84 at full extension of the umbrella pole 61. FIG. 23 depicts the same configuration as FIG. 22 but with only a single chair 83 that is spaced widely from the pickup truck 81. In FIG. 24, a substantial portion of umbrella pole 61 has been received within the angled base pole 40 so that the canopy 65 covers a portion of the back of the pickup truck 81 and the chair 83 is positioned closer to the pickup truck.

Figure 25:
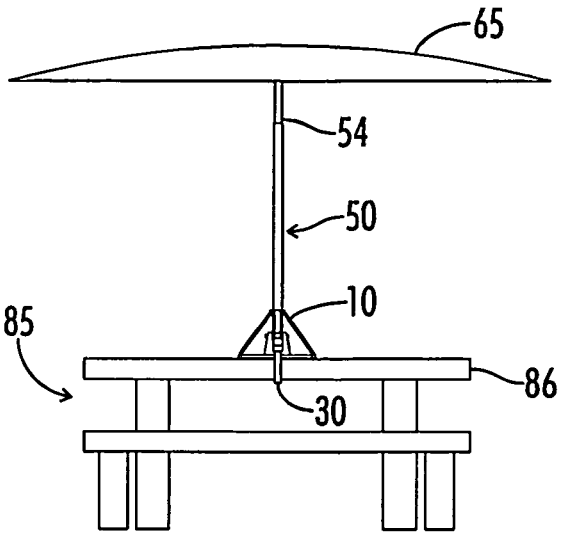
FIG. 25 is a side view of a mount attached with a strap to a table top and an umbrella canopy on a straight base pole.
Figure 26:
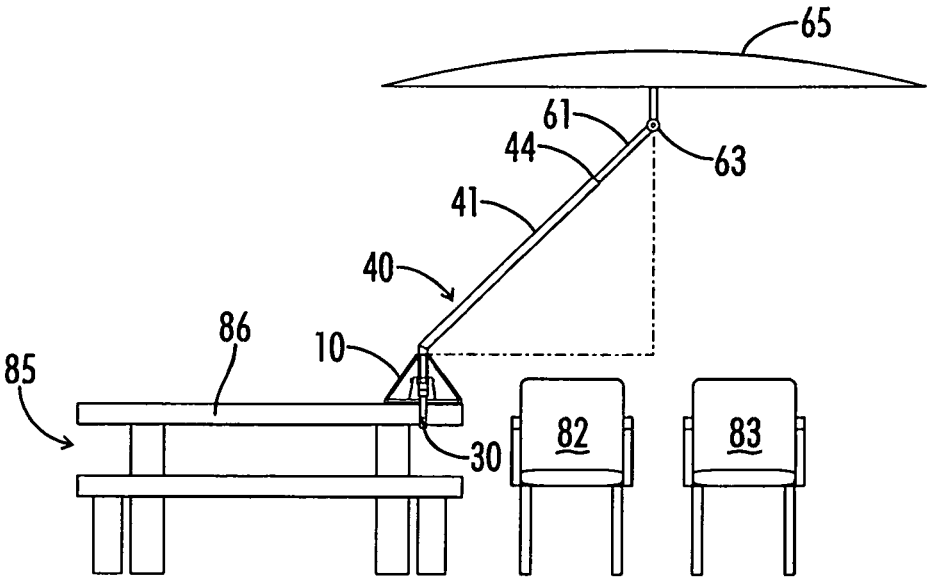
FIG. 26 is a side view of a mount attached with a strap to a table top and an umbrella with a 45° angle base pole extending laterally over two chairs.

FIGS. 25 and 26 illustrate attachment of the mount 10 to another base support which in this case is the top 86 of a picnic table 85. In FIG. 25, the mount 10 is secured by strap 30 about the table top support 86 and the straight base pole 50 elevates the canopy to a height not greatly above the length of the base pole 50 because a substantial portion of umbrella pole 61 has been received within the base pole. In this particular illustration, the umbrella is not provided with a swivel joint and the umbrella canopy 65 is horizontal and directly above the picnic table 85 and mount 10. In FIG. 26, the mount 10 is again secured by strap 30 to base support 86 but the angle base pole 40 is utilized to offset the canopy 65 at a 45 degree angle. Again, the umbrella pole 61 is largely received within pole 41 so that the canopy is not extended to its maximum distance away from the mount 10. However, it can be seen that the canopy completely covers two chairs 82,83 positioned laterally to the side of the picnic table 85. By utilizing the many adjusting features of the illustrated embodiment of the invention, the canopy 65 can be securely positioned in numerous locations and orientations. Versatility is provided by the ability of mount 10, with or without adapter 20, to be secured to many different stationary objects. The selection of straight or angled base poles provides additional versatility as does the ability to rotate the angled base pole to four or preferably eight different angular orientations with regard to the position of the mount 10. The ability to adjust the length of the umbrella pole by receiving a portion of that pole within the angled base pole or straight base pole provides additional adaptability as does the swivel joint 63.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

I claim:

1. A mount for holding an umbrella in position on a base support comprising:

a base having a top side and a bottom side;

a pole receiver connected to and extending from the top side perpendicular to the base;

at least two pressure points spaced about the pole receiver; and at least one strap with a fastener encircling the base support and holding the pressure points relative to the base support.

2. The mount of claim 1 further comprising a plurality of openings passing through the base and threaded fasteners in such openings attaching the mount to the base support.

3. The mount of claim 1 wherein the pole receiver has an opening with a polygonal cross-sectional shape.

4. The mount of claim 1 wherein the pole receiver has an opening with a circular cross-sectional shape.

5. The mount of claim 1 wherein the pressure points are in a form of a clevis holding a cross-pin about which the strap is looped.

6. The mount of claim 1 wherein the fastener is a ratchet.

7. The mount of claim 1 further comprising an angled base pole having a base portion received in the pole receiver and a pole section extending upward from the base portion at an angle of between 30° and 60°.

8. The mount of claim 7 further comprising an umbrella pole interfitting with the pole section, a swivel joint, and a canopy.

9. The mount of claim 8 wherein the swivel joint is set an angle opposite the angle of the angled base pole.

10. The mount of claim 1 further comprising a straight pole received in the pole receiver and extending upward and supporting a canopy.

11. The mount of claim 1 wherein the base support is selected from a group of rounded members of an eight inches in diameter or less and rectangular members of an eight inches width or less, and further comprises an adaptor interposed between the base support and the mount.

12. The mount of claim 11 wherein the bottom side of the mount interfits with a top surface of the adaptor.

13. The mount of claim 11 wherein the adaptor has a top surface facing the mount and a curved bottom surface facing the base member.

14. The mount of claim 13 wherein the curved bottom surface of the adaptor is notched.

15. The mount of claim 1 wherein the pole receiver has an opening to receive a pole and an insert is set in the opening alter a size of the opening.

16. The mount of claim 7 wherein the angled base pole can be fixed in at least four-different positions to change the outward angular orientation of the pole section.

17. A mount for holding an umbrella in position on a rounded vertical base support comprising:

a base having a top side and a bottom side;

a pole receiver connected to and extending from the top side perpendicular to the base;

at least two pressure points spaced about the pole receiver;

an adaptor having a top surface facing the bottom side of the base and a curved bottom surface facing the rounded vertical base support; and at least one strap with a fastener encircling the adaptor and base support and urging the pressure points against the base support.

18. The mount of claim 17 further comprising an angled base pole having a base portion received in the pole receiver and a pole section extending outward and upward from the base portion at an angle of 45°, an umbrella pole interfitting with the pole section, a swivel joint on the umbrella pole set an 45° angle opposite the angle of the angled base pole, and a horizontal canopy connected thereto.

19. A mount for holding an umbrella in position on a rectangular base support comprising:

a base having a top side and a bottom side;

a pole receiver connected to and extending from the top side perpendicular to the base;

at least two pressure points spaced about the pole receiver;

an adaptor having a top surface facing the bottom side of the base and a curved bottom surface with notches facing the rectangular base support; and at least one strap with a fastener encircling the adaptor and base support and urging the pressure points against the base support.

20. The mount of claim 19 further comprising an angled base pole having a base portion received in the pole receiver and a pole section extending outward and upward from the base portion at an angle of 45°, an umbrella pole interfitting with the pole section, a swivel joint set an 45° angle opposite the angle of the angled base pole, and a horizontal canopy.

* * * * *